US005753004A

United States Patent [19]

Hanai et al.

[11] Patent Number: 5,753,004

[45] Date of Patent: May 19, 1998

[54] METHOD FOR REFINING MOLTEN METAL AND APPARATUS FOR SAME

[75] Inventors: Noboru Hanai, Yonago; Kokichi Mikutsu, Fukaya; Tamiya Kishida; Mitsuru Suzuki, both of Yonago; Katsumi Kanamoto, Yasugi; Takashi Mukai, Yonago; Iwao Kashiwagi; Kenji Tokuda, both of Yasugi, all of Japan

[73] Assignee: Hitachi Metals, Ltd., Tokyo, Japan

[21] Appl. No.: 586,871

[22] PCT Filed: Dec. 27, 1994

[86] PCT No.: PCT/JP94/02268

§ 371 Date: Jan. 24, 1996

§ 102(e) Date: Jan. 24, 1996

[87] PCT Pub. No.: WO95/32312

PCT Pub. Date: Nov. 30, 1995

[30] Foreign Application Priority Data

| | | | |
|---|---|---|---|
| May 25, 1994 | [JP] | Japan | 6-111098 |
| Nov. 25, 1994 | [JP] | Japan | 6-291154 |
| Nov. 25, 1994 | [JP] | Japan | 6-291158 |

[51] Int. Cl.[6] ..... C21B 11/10

[52] U.S. Cl. ..... 75/10.14; 75/10.15; 75/10.19; 75/10.22; 75/10.64; 266/208; 266/211; 373/7; 373/18

[58] Field of Search ..... 75/10.15, 10.19, 75/10.22, 10.14, 10.64; 266/207, 208, 211; 373/7, 18

[56] References Cited

U.S. PATENT DOCUMENTS

| | | | |
|---|---|---|---|
| 4,773,079 | 9/1988 | Bruckmann et al. | 373/141 |

FOREIGN PATENT DOCUMENTS

| | | | |
|---|---|---|---|
| 50-06409 | 3/1975 | Japan | 75/10.22 |
| 55-48084 | 12/1980 | Japan . | |
| 58-221220 | 12/1983 | Japan . | |
| 3-294414 | 12/1991 | Japan . | |
| 4-323314 | 1/1992 | Japan . | |
| 4-318118 | 11/1992 | Japan . | |
| 5-186814 | 7/1993 | Japan . | |

*Primary Examiner*—Melvyn Andrews
*Attorney, Agent, or Firm*—Finnegan, Henderson, Farabow, Garrett & Dunner, L.L.P.

[57] ABSTRACT

A method of refining molten metal includes the steps of reduced-pressure-refining molten metal in a heated vessel, adding slag-forming agents into the refined molten metal while keeping the molten metal in the vessel, or after pouring the molten metal into another vessel, re-refining the molten metal by heating the molten metal with inert-gas plasma and while stirring the molten metal as occasion demands. Preferably, the refining apparatus includes two adjacent chambers, each chamber isolated from the surrounding atmosphere. The chambers can be connected with, or separated from, each other and each chamber is provided with an exhaust device. One of the chambers is provided with an induction heating refining furnace, and the other chamber is provided with inert gas plasma heater. The apparatus also includes a re-refining vessel which is transferable between the two chambers, and a material feeder for feeding slag-forming agents into the re-refining vessel.

16 Claims, 6 Drawing Sheets

METHOD FOR REFINING MOLTEN METAL AND APPARATUS FOR SAME

TECHNICAL FIELD

The present invention relates to a method for refining a molten metal and apparatus therefor, in which the molten metal is refined in a vacuum or in a low oxygen partial pressure atmosphere such as an inert gas atmosphere up to several hundreds of torr, then the refined molten metal is further refined substantially under a surrounding atmosphere.

BACKGROUND ART

A method for refining a molten metal in a vacuum or in a low oxygen partial pressure atmosphere (hereinafter called "reduced-pressure-refining") has widely been used because a high grade steel can be obtained easily, and a vacuum induction furnace (VIF) is one of means for this method.

In the reduced-pressure-refining, some impurities are separated while being evaporated from, scattered above or floated onto the molten metal as themselves or as their compounds such as oxides, so that the refining proceeds. In this case the amount of impurities in the molten metal can be lowered very much. (In the present invention, the term "impurities" used herein generally mean impurity elements or substances causing non-metallic inclusions.)

In the reduced-pressure-refining, a part of the evaporated and/or scattered components is condensed on the free-board part of the furnace wall, and adheres thereon as scum. Further, on the surface of the molten metal in a refining furnace, other impurities that cannot evaporate are floated and separated as dross. Thus, when the molten metal is poured by tilting the refining furnace, the adhered substance and floating substances are washed away by the melt flow, and mixed in the molten metal again.

In a case where the refractory lining of the ladle or tundish used as a receiving vessel is not heated sufficiently before receiving molten metal, there occurs such a problem that the molten metal is polluted by active gas components absorbed in the refractory lining. Further, the refractory lining of the molten metal-receiving vessel partially reacts with the molten metal that have been activated by the reduced-pressure-refining, or is eroded by the molten metal, with the result that there occurs such a case as the molten metal is polluted by these reaction products and erosion products.

Further, in a case where the molten metal is directly exposed to atmospheric pressure after the reduced-pressure-refining, the impurities that cannot evaporate, such as dross, dissolve in the molten metal again to contaminate the molten metal.

In order to prevent the adhered substance and the floating substance from being mixed into a molten metal, there have been proposed a method in which the molten metal is discharged from the bottom of the refining furnace while leaving a part of the molten metal in the furnace for preventing the mixing of floating impurities, and another proposed method in which the refining and discharging of the molten metal is effected by use of an induction skull furnace so that the molten metal is not in contact with furnace wall.

Further, after the discharging of molten metal, there has been proposed a method in which metallic inclusions-causing substances are removed in the ladle or tundish by using a ceramic filter. Although some of them are practically used, these methods have not yet been adopted widely due to various limitations. Since these proposed methods are not always effective to all substances and contaminants to be mixed, these methods must be combined to make the methods effective to all of the substances to be mixed. However, the combination of these methods causes such problems as to make the cost thereof higher.

On the other hand, in order to remove the re-mixed substances etc., it may be possible to effect re-refining after vacuum refining by use of a ladle refining furnace of a graphite electrode arc heating type or a ASEA-SKF furnace. However, these methods cause such a problem as to pick up carbon into the molten metal.

JP-A-4-318118 discloses a method for producing ultra-low carbon, ultra-low sulfur steel in which method, after the decarburization of molten metal by a vacuum degassing treatment, the molten metal is plasma-heated under a condition where the molten metal contains dissolved aluminum not less than 0.2% by weight, and the stirring of the molten metal is performed in the presence of slag having a basicity not less than 8 to thereby effect desulfurization.

It has been known that the above proposed methods are not suitable in a case where the kind of materials to be handled or the level of required refining are diversified as is often the case of special steel manufacturers, or in a case where a furnace of relatively small capacity is used. This is, in these cases, a period of time for vacuum degassing often differs very much in dependence on the kind of materials and refining levels, and is often prolonged over a previously estimated time. Further, in a case where a small furnace is used, desired vacuum degassing effect can not been achieved due to the temperature lowering of the molten metal.

DISCLOSURE OF THE INVENTION

It is an object of the present invention to provide a method and apparatus for refining a molten metal without such problems as to pick up carbon while flexibly coping with such cases as change in the kind of materials of the molten metal and in refining level, refining by use of a small capacity furnace, and high-level refining.

According to one aspect of the present invention there is provided a method for refining metal, comprising the steps of effecting reduced-pressure-refining of a molten metal in a vessel with a heating means in a vacuum or low oxygen partial pressure atmosphere, adding slag-forming agents in the molten metal, and heating the molten metal by use of inert gas plasma so that re-refining of the molten metal is performed.

In the present specification, the term "reduced-pressure-refining" means "refining effected under a pressure lower than the pressure of the surrounding atmosphere".

In the method of the invention, at first, reduced-pressure-refining is effected under a vacuum or low oxygen partial pressure atmosphere in a vessel provided with heater means so that a predetermined level of reduced-pressure-refining is performed. In re-refining successively effected, it may be performed in the same vessel as used in the reduced-pressure-refining or in another new vessel. For example, in a case where no new vessel is used, it is allowed for a some degree of scum-like or dross-like impurities existing in the vessel to be included in the molten metal, and slag-forming agents are successively added in the vessel having been used for performing the reduced-pressure-refining so that the molten metal is re-refined. In another case where another new vessel is used for performing the re-refining, molten metal is discharged from the first vessel into the new vessel by tilting the first vessel or by use of other molten metal-discharging process, and slag-forming agents are added into the new vessel so that the re-refining of the molten metal is performed. In the present invention, the re-refining makes it possible to effectively remove the impurities mixed in the molten metal so that a high level of refining of the molten metal may be performed. It is preferred that the heating means is induction heating.

In the method of the invention, since it is unnecessary to reform slag at the stage of re-refining, there occurs such an advantage as makes it possible to perform remarkably effective re-refining.

As explained above, the scum-like or dross-like impurities, which incidentally occurs in the step of reduced-pressure-refining, are substantially removed by successively adding slag-forming agents, or by adding the slag-forming agents into another new vessel into which the molten metal had been transferred by a tilting process or other molten metal-discharging processes, whereby the impurities mixed in the molten metal is removed by re-refining. In performing the re-refining in the method, it is very important to heat the newly added slag-forming agents by use of inert gas plasma-heating while stirring the molten metal. A preferred stirring means is the blowing of an inert gas from porous plugs provided in the bottom of the vessel or is electromagnetic stirring.

Further, in the invention it is preferable to transfer molten metal, which had been reduced-pressure-refined, into another new vessel. However, even in this case there occurs a problem. That is, in a case where the refractories of an inner wall located in a ladle or tundish which receives the molten metal are not heated sufficiently, the molten metal comes to be contaminated by active gas adsorbed in the refractories. In addition, the refractories of the molten metal-receiving vessel react partially with the molten metal which had become reactive by the reduced-pressure-refining or are partially eroded by the molten metal, with the result that reaction product and/or eroded product occurs to pollute the molten metal.

When exposing the molten metal to surrounding atmosphere after performing the refining under vacuum or low oxygen partial pressure, the lowering of temperature of the molten metal occurs naturally. The longer the period of time for rising the temperature of the molten metal up to a refining temperature becomes, the more the amount of dross-like unevaporatable impurities is dissolved again in the molten metal. Thus, it is preferred to provide a cover on the top of the new vessel, to open the cover only when the molten metal is poured into the new vessel, and to perform other operations while closing the cover body of the new vessel.

As explained above, the earlier the re-refining is commenced, that is, the less the impurities are dissolved again in the molten metal prior to the re-refining, the more the re-refining becomes effective.

Further, in the invention the re-refining is performed by adding the slag-forming agents. Thus, when no vessel is renewed as in the case explained above, this addition of the slag-forming agents makes the level of slag rise, so that the impurities having been separated in a scum state on a free board portion of the vessel act to again contaminate the slag. Accordingly, it is preferred to transfer into a renewed vessel the molten metal having been reduced-pressure-refined under vacuum or low oxygen partial pressure, and then to perform the re-refining.

In order to make the re-refining efficient, it is necessary to raise the temperature of the molten metal up to a predetermined temperature as soon as possible after having received the molten metal into the renewed vessel and after having added sub-raw materials such as slag-forming agents etc. therein (, this step being hereinafter referred to as "the step of receiving molten metal and etc.")

Thus, in the method of the invention it is preferred to perform the step of receiving the molten metal and etc. while keeping the renewed re-refining vessel in a high temperature state. In usual operations, it is effective to use an identical re-refining vessel regarding each of the operations, and to synchronize both the reduced-pressure-refining and the re-refining including the step of discharging the molten metal into an ingot case (casting) so that the step of receiving the molten metal and etc. in the renewed vessel can be performed immediately after this discharging so as to prevent the needless heat dissipation of the re-refining vessel.

As a result of experiment, it is found that in this high temperature state the temperature difference between the maximum temperature of the inner refractory layer of the re-refining vessel (, the temperature of the inner wall surface of which vessel is apt to be varied due to radiation cooling,) and the temperature of the molten metal to be received (, this temperature difference being hereinbelow referred to as "rise temperature differential",) is preferably made to be within a range of 150° C.

As means for heating the re-refining vessel in a non-steady state operation, it is possible to use heating with a burner, heating in a non-transfer mode of an inert gas plasma heating device for re-refining, heating in a dummy operation, or combination of these heating means.

The rise temperature differential is preferably not less than 150° C. as explained above, and is more preferably not less than 100° C.

The re-refining vessel in which the step of receiving molten metal and etc. is performed is preferably provided with a cover body capable of being opened or closed like a door around a horizontal pin so that there is obtained an opening having a shape and area sufficient to receive the molten metal.

In the invention, the vacuum or low oxygen partial pressure atmosphere means an atmosphere having a pressure less than that of the surrounding atmosphere or an atmosphere having an oxygen partial pressure less than 213 HPa(1013 HPa×0.21) which is the oxygen partial pressure of the surrounding atmosphere. In order to provide the vacuum or low oxygen partial pressure atmosphere, a vacuum pump is used to exhaust gas to thereby obtain the vacuum, or a part of oxygen is replaced by an inert gas (Ar or He) so that an inert gas atmosphere having a pressure not more than several hundreds Torr is obtained.

Further, it is preferred that, at the time of finishing the reduced-pressure-refining followed by re-refining which is performed under plasma heating, the molten metal is in a state in which no slag exists substantially, which state means that, even in a case where slag-forming agents are added to perform the reduced-pressure-refining through VOD, slag is removed by use of any means when the re-refining begins after the reduced-pressure-refining.

In a case where the reduced-pressure-refining is performed by use of a vacuum induction melting furnace and then a renewed vessel is used, slag-forming agents may be added into a molten metal immediately before the finish of the reduced-pressure-refining or immediately after the finish of the reduced-pressure-refining but prior to the pouring of the molten metal into another renewed vessel so that the re-refining is performed promptly, that is, the addition of the slag-forming agents at this stage is included in the method of the invention.

The inert gas plasma heating device does not cause such oxidizing gases of $CO_2$, $H_2O$, free $O_2$ and etc. as will occur in a case of using a burner, and is suitable to provide the high temperature state. In a case where new slag-forming agents are added during the re-refining, it is necessary to promptly heating the agents to provide a slag having fluidity so that the slag is in contact with the molten metal to accelerate deoxidation and desulfurization reactions as soon as possible, in view of which respect the inert gas plasma heating is effective.

According to still another aspect of the present invention, there is provided refining apparatus for re-refining molten metal after the reduced-pressure-refining of the molten metal had been performed, which apparatus comprises a furnace for reduced-pressure-refining provided with heating means, and a re-refining furnace provided with a device for inert gas plasma heating and another device for charging subsidiary raw materials in the re-refining furnace, both the furnaces being located close to each other.

According to another aspect of the present invention, there is provided refining apparatus for re-refining molten metal after the reduced-pressure-refining of the molten metal had been performed, which apparatus comprises: two chambers which can be connected with each other or can be separated from each other, each of the chambers being provided with an exhaust system and being able to be isolated from the surrounding atmosphere; a reduced-pressure-refining furnace located in one of the chambers which furnace has heating means and from which furnace the molten metal received therein can be discharged; a device for inert gas plasma heating located in another of the chambers; a re-refining vessel movable between a position where the re-refining vessel receives the molten metal from the reduced-pressure-refining furnace and another position where the re-refining of the molten metal is performed by use of the inert gas plasma heating device; and a device for feeding in the re-refining vessel subsidiary raw materials including slag-forming agents.

According to another aspect of the present invention, there is provided refining apparatus for re-refining molten metal after the reduced-pressure-refining of the molten metal had been performed, which apparatus comprises: two chambers which can be in communication with each other or can be isolated from each other, each of the chambers being provided with an exhaust system and being able to be isolated from the surrounding atmosphere; a reduced-pressure-refining furnace located in one of the chambers which furnace has heating means and from which furnace the molten metal received therein can be discharged; a device for inert gas plasma heating located in another of the chambers; a re-refining vessel transferable between a position where the re-refining vessel receives the molten metal from the reduced-pressure-refining furnace and another position where the re-refining of the molten metal is performed by use of the inert gas plasma heating device, the re-refining vessel being provided at the top thereof with a cover opening or closing or freely detachable; and a device for feeding in the re-refining vessel subsidiary raw materials including slag-forming agents which device is located at or in the vicinity of a position where the reduced-pressure-refined molten metal is poured into the re-refining vessel or is located at or in the vicinity of another position where the re-refining of the molten metal is performed.

As heating means usable in the reduced-pressure-refining furnace in the apparatus of the invention, there are such various means as induction heating, electron beam, arc heating, combustion heating by use of oxygen gas and etc., the induction heating device being preferred. In the present invention, the term "subsidiary raw materials" means slag-forming agents and elements to be added. In the refining apparatus of the invention it is preferred that the whole of the vessel of the reduced-pressure-refining furnace is located within a chamber isolated from the surrounding atmosphere, and that the re-refining furnace is located within another chamber isolated from the surrounding atmosphere (which another chamber is distinguished from the first chamber).

Since in the refining method of the invention the reduced-pressure-refining is performed in the vessel provided with the heating means which can be used as occasion demand so as to prevent the temperature of the molten metal from lowering, it becomes possible to perform refining while satisfying such various conditions as various kinds of steel to be produced, required various refining levels, and relatively small amount of metal, whereby it becomes possible to obtain molten metal having a predetermined refining level while flexibly coping with the variation of various production conditions. Of course, it is possible to perform the starting-up of the refining by use of cold materials.

In the refining method according to the second aspect of the invention, since the re-refining is preferably performed by use of a new vessel having been renewed, no contamination of slag due to the scum-like impurities occurs even when the level of the slag is raised by the addition of the slag-forming agents, so that molten metal refined in a high degree can be readily obtained.

In the re-refining of the method of the invention, the efficient adsorption of remaining impurities by use of slag activated during the inert gas plasma heating is performed before impurities is again dissolved into a molten metal which impurities had been separated in the step of the reduced-pressure-refining. That is, in the invention, the slag is sufficiently heated by inert gas plasma heating to thereby become low in viscosity and become activated, so that it becomes possible to efficiently catch such re-contaminated substances as the sticky substance, the floating substance and etc. and contaminated substances caused due to the refractory, in which the blowing of inert gas etc. is preferably performed to sufficiently stir the molten metal so that the slag is sufficiently in mutual contact with molten metal to bring about high refining effect.

The inert gas plasma heating covers the surfaces of the molten metal and the slag while efficiently heating the slag, so that it prevents the molten metal from being oxidized and prevents the slag from becoming acid while compensating the temperature lowering of molten metal, in which inert gas plasma heating there does not occur such fear of re-contamination as carbon picking-up which is apt to occur in the case of an arc heating process by use of graphite electrodes.

In a case where a vessel is renewed in the refining method of the invention, it is important to start the re-refining as soon as possible after the molten metal had been received in the renewed vessel. Namely, since such contaminated substances as the sticky substances and floating substances described above are evenly dissolved in the molten metal as time lapses, the efficient refining can be achieved by finishing the refining before these contaminated substances are dissolved in the molten metal.

In the method of refining molten metal in the invention, in a case where the re-refining is performed under surrounding atmospheric pressure or reduced vacuum pressure in a vessel other than a vessel in which the reduced pressure-refining had been performed, a part of the scum on the inner wall face of the reduced-pressure-refining vessel, which part is in contact with a molten metal at the time of pouring the molten metal into the renewed vessel by tilting the reduced-pressure-refining vessel, comes to be mixed in the molten metal, however, the mixing amount of the scum in the molten metal is advantageously reduced about one fifth or one sixth as low as that of scum contained when no reduced-pressure-refining vessel is replaced.

Further, in the refining method of the invention, when the temperature difference between the inner wall refractory of the re-refining vessel and the molten metal just before the pouring it into the re-refining vessel is set to be within a range of 150° C., it becomes possible to minimize the decrease of both the reaction speed of refining and the diffusion speed which decrease occurs when the molten metal is cooled due to the refractory, it being possible to achieve the re-refining of a steady-state in a shortest period of time, and it becomes possible to efficiently perform refining while removing contaminated substances within such a period of time as the dissolution of the contaminated substances is minimized. By making the temperature of the inner wall refractory high sufficiently, the refractory becomes a passive (non-reactive) state to thereby make the amount of adsorbed gas little, so that the degree of pollution due to the dissolution of the refractory and the transferring of the adsorbed gas into the molten metal is made to be a low level, and there occurs such a secondary advantage as a refining load decreases.

In the apparatus of the invention, the vessel for receiving the molten metal which had been reduced-pressure-refined is quickly movable to a location where the re-refining of the molten metal is to be performed, and the subsidiary raw materials can be quickly added in the molten metal in the vicinity of the vessel, so that the slag-forming agents in the re-refining vessel is sufficiently heated by the inert gas plasma heating to thereby become low in viscosity and to become activated with the result that the re-contaminated substances such as the adhering substance and the floating substance etc. and the pollution substance caused by the refractory can be efficiently removed. Further, in a case where the blowing of an inert gas etc. is combined, sufficient stirring occurs to make both the molten metal and the slag be in sufficient contact with each other, so that refining effect of a high degree can be brought about.

According to experiments, it is preferred that the rising temperature differential is within 150° C., and more preferably it is not more than 100° C. As the rising temperature differential becomes larger than 150° C., the cooling of the molten metal increases to cause the delay of the usual re-refining, to cause the increase of the reaction between the molten metal and the refractory of the re-refining vessel, and to cause the molten metal to adsorb gas components having been adsorbed in the refractory, that is, there occurs the contamination of molten metal.

The reasons why the two chambers isolated from the surrounding atmosphere are provided closely to each other and the function thereof are explained below. Since in the invention the reduced-pressure-refining is performed in the vessel with the heating means and under vacuum or low oxygen partial pressure atmosphere and, it is necessary for the reduced-pressure-refining furnace to be located in the chamber isolated from the surrounding atmosphere which chamber is provided with the exhaust system. The molten metal the reduced-pressure-refining of which had been finished may be transferable through a ladle into the new vessel for the re-refining, however, in order to minimize the damage of the refractories and the number of steps it is preferred for the ladle to be also used as the new vessel for the re-refining. In either case the ladle to receive the molten metal the reduced-pressure-refining of which had been finished is necessary to be moved in the chamber isolated from the surrounding atmosphere (this chamber is referred to hereinbelow as "the first atmosphere-isolation chamber"). Embodiments of the apparatus appropriate for this respect are shown in FIGS. 1 and 2. In this case, by previously preparing the ladle 27 in another chamber isolated from the surrounding atmosphere (this chamber is referred to hereinbelow as "the second atmosphere-isolation chamber") under vacuum or low oxygen partial pressure atmosphere (FIG. 1), it becomes possible to transfer the ladle from the second atmosphere-isolation chamber (b) to the first atmosphere-isolation chamber (a) under the substantially same reduced pressure condition when the first atmosphere-isolation chamber is in communication with the second atmosphere-isolation chamber. Inversely, the transfer thereof from the first atmosphere-isolation chamber to the second chamber is readily performed under a vacuum or reduced pressure. As the advantage of this operation, the molten metal obtained by the reduced-pressure-refining can be prevented from contacting with the surrounding atmosphere, and can be used for the prompt start of the re-refining while maintaining a pure state. Once the plasma heating device is installed on the ladle (, as explained above, which ladle usually becomes the vessel for re-refining), the reduced pressure state in the second atmosphere-isolation chamber becomes unnecessary, and the re-refining is performed under the surrounding atmosphere.

In another apparatus of the invention there is excluded the second atmosphere-isolation chamber. A typical example of the apparatus is shown in FIG. 2 (in which a subsidiary raw material-charging system 9 is provided outside an atmosphere-isolation chamber (a)). Namely, since the re-refining by use of the gas plasma heating device is performed under the surrounding atmosphere, the second atmosphere-isolation chamber becomes unnecessary in a case where molten metal can be promptly located under the plasma heating device after the completion of refining thereof in the reduced-pressure-refining furnace. For this purpose, it is necessary to locate the inert gas plasma heating device for the re-refining in the vicinity of the first atmosphere-isolation chamber, and to make the vessel for the re-refining transferable between the first atmosphere-isolation chamber and the inert gas plasma heating device. As a means for making it transferable, for example, the movement of a truck on rails is convenient.

In a case where a furnace for the reduced-pressure-refining is small in size, it is also possible to hang and convey the furnace or ladle itself to the plasma re-refining furnace by use of an upper crane after opening a cover of the first atmosphere-isolation chamber.

The apparatus of the invention is typical means for specifically performing the method of the invention. Among them, an induction heating refining furnace does not cause any carburization action, can prevent the lowering of the temperature of molten metal or can raise the molten metal temperature because of its heating ability, can dissolve raw materials to be melted as occasion demands, and makes it possible to perform the refining to a relatively low impurity level with a high efficiency and with a low cost.

The method of the invention can be performed by use of devices other than those explained above. For example, as heating means for the reduced-pressure-refining furnace, there may be adopted arc heating or electron beam heating. Further, as the specific shape of a furnace there may be used a vacuum plasma furnace or VOD and etc. The refining by use of them is also refining under vacuum or reduced pressure, the molten metal which had been reduced-pressure-refined by use of them being transferred into a renewed vessel of a high temperature state substantially without any slag, and the re-refining thereof can be performed by adding slag-forming agents and then by heating through the inert gas plasma heating.

In the invention, in such a molten metal-pouring system as the reduced-pressure-refining furnace provided with the heating means is tilted to perform the pouring of molten metal, it becomes possible to achieve the high speed pouring of the molten metal while achieving both the simplification of apparatus and the reliability of the operation.

Since in the refining apparatus of the invention the inert gas plasma heating device is located in the vicinity of the reduced-pressure-refining furnace, a period of time necessary for moving the reduced-pressure-refined molten metal is minimized, and the molten metal can be promptly transferred to a re-refining position. Further, since the re-refining vessel is previously heated to a high temperature state as explained in connection with the method of the invention, the molten metal is promptly refined effectively without being excessively cooled.

In the apparatus of the invention, in a case where the subsidiary raw materials are added at the same position as the molten metal-receiving position or in the vicinity of the molten metal-receiving position, or alternatively at the same position as the re-refining position or in the vicinity of the re-refining position, the operation of the receiving of the molten metal and etc. can be further promptly performed.

Further, in the apparatus in which the re-refining position is provided in another chamber, the atmosphere and pressure etc. can be independently controlled, with the result that it becomes possible to perform the synchronizing of operations (steady state workings) effected at the same time so that the re-refining vessel is prevented from being cooled unnecessarily.

The re-refining vessel used in the apparatus of the invention is provided at the top thereof with the cover openable or closable or freely detachable so that the re-refining vessel can receive molten metal by the tilting or etc. of the reduced-pressure-refining furnace such as the induction heating refining furnace etc. explained above. The cover located at the top of the re-refining vessel is openable or closable and is freely detachable or attachable. What is meant by the wording "freely detachable or attachable" is that the cover may be attached or may be detached. When the cover is detached, the detached cover may be held at the upper part of the plasma heating device and may be again attached on the upper part of the re-refining vessel after the plasma heating device had been set at the re-refining vessel.

The pouring of the molten metal by tilting is satisfactory in view of both the simplification of the device and the reliability of operation, however, with respect to the aspect of receiving the molten metal the pouring of the molten metal by tilting is usually troublesome because both the location of a trough or a tapping hole and the direction of the discharged molten metal vary in dependence upon the angle at the tilting. In the apparatus of the invention, since there is provided the cover openable or freely detachable, it becomes possible to directly pour the molten metal at a very high speed without using any funnel-like molten-metal-receiving means, with the result that it becomes possible to minimize the lowering of temperature.

EMBODIMENTS

Embodiment 1

Typical embodiments of a refining apparatus embodying the invention are described by use of a representative example in which an inductive heating refining furnace is used as a reduced-pressure-refining furnace.

Figure 1:
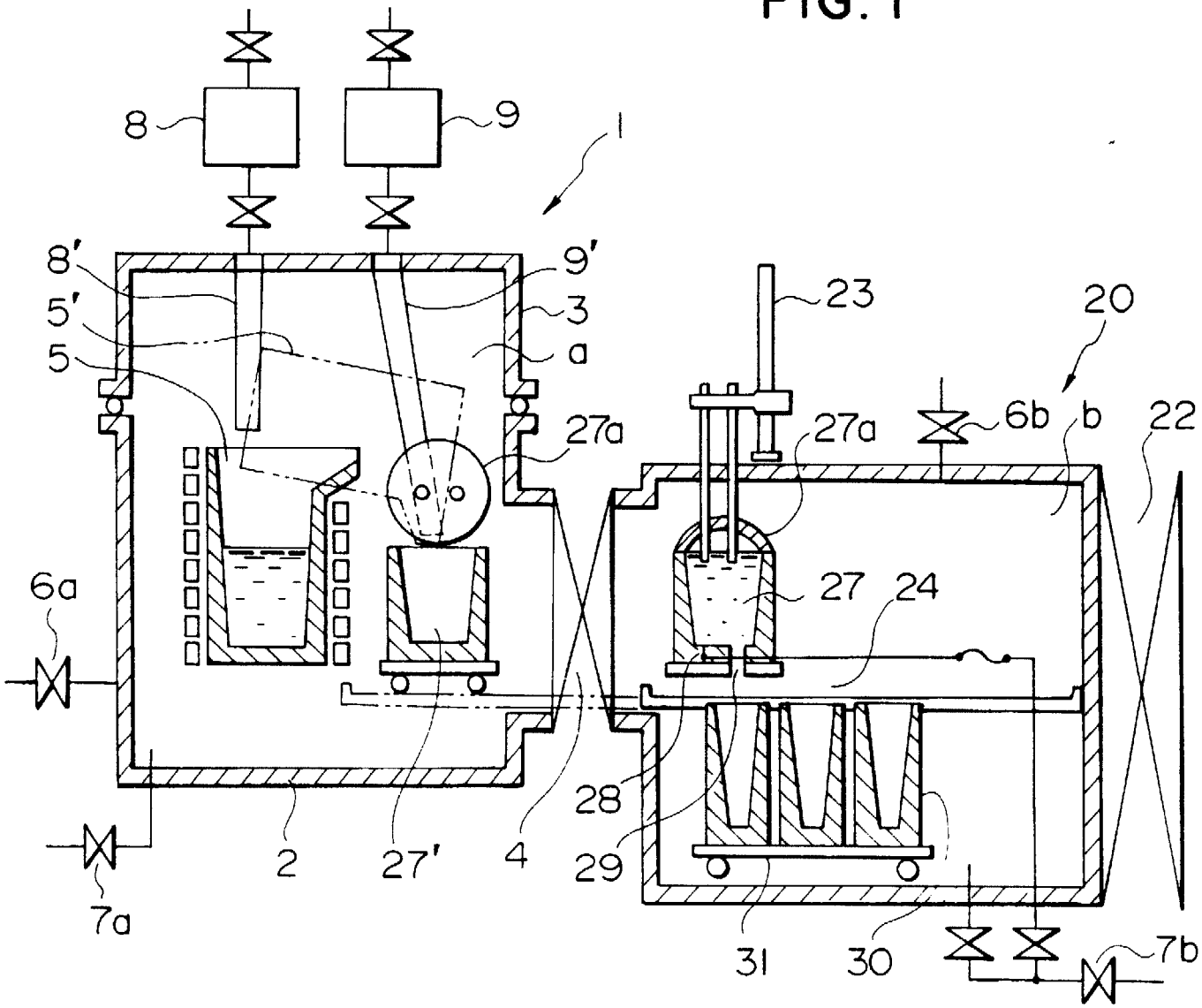
FIG. 1 is a drawing which illustrates an arrangement of an apparatus embodying the invention.
Figure 2:
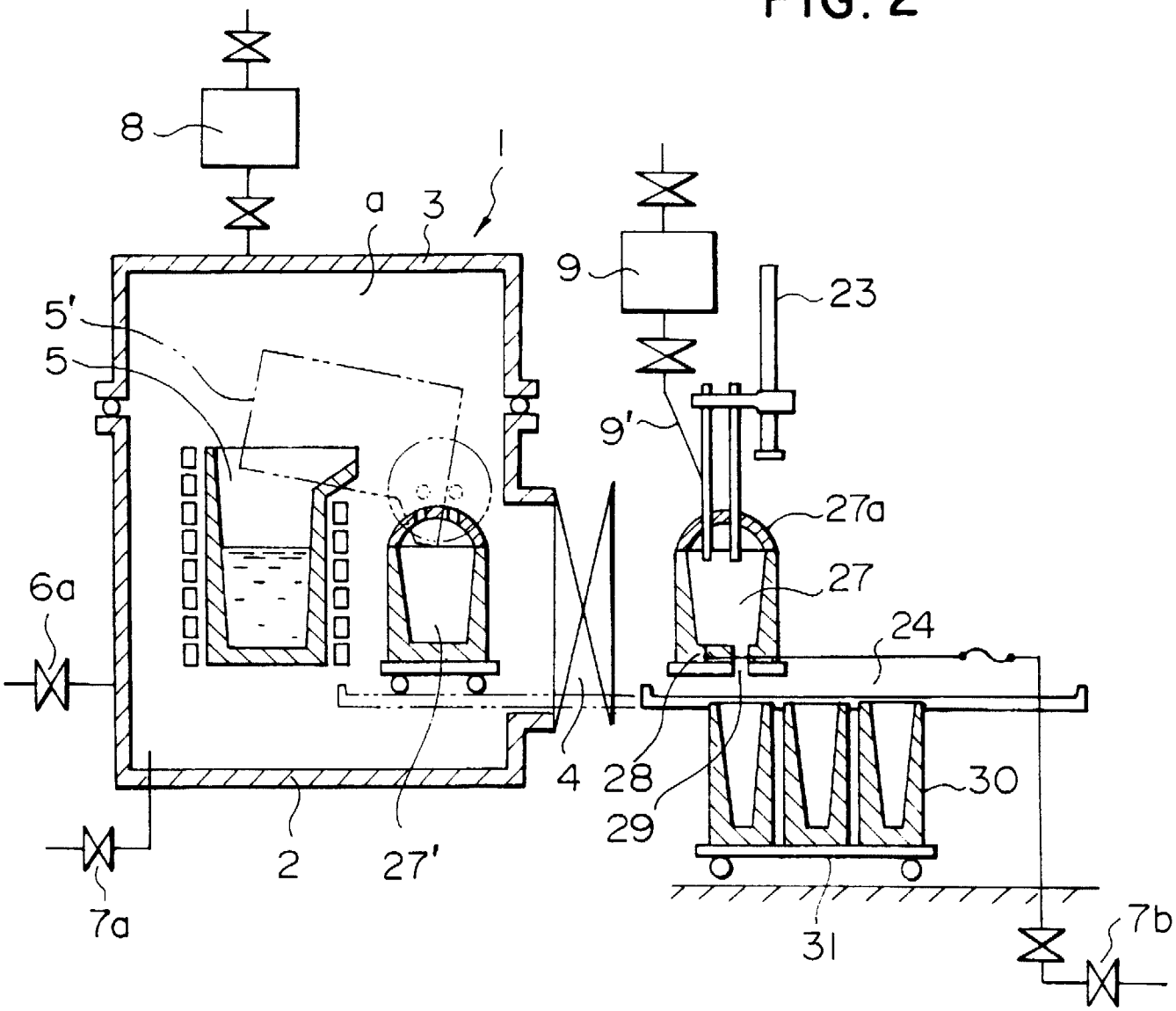
FIG. 2 is a drawing which illustrates another arrangement of an apparatus embodying the invention.

FIG. 1 shows an example of arrangement of the refining apparatus embodying the invention. The reduced-pressure-refining apparatus 1 comprises: an atmosphere isolation chamber (a) having a cover or cap 3 and an atmosphere isolation chamber housing 2 provided with a partitioning valve 4 in a side wall; an inductive heating refining furnace 5 installed in the atmosphere isolation chamber (a); a vacuum evacuation system 6*a* including a valve; a feeding systems 8 (used for the inductive heating refining furnace) and 9 (used for a re-refining container) both for supplying slag-forming agents and/or raw materials such as alloys, which systems have chutes 8' and 9' that rotatively move to avoid interference with the tilted inductive heating refining furnace 5' during the tilt-pouring of molten metal; and an inert gas feeding system 7*a* including a valve. Although, in this embodiment, the subsidiary raw material feeding system is located within the atmosphere isolation chamber (a), it may be located near a re-refining position 27 (see FIG. 2).

A re-refining apparatus 20 comprises: an atmosphere isolation chamber (b) installed adjacent to the atmosphere isolation chamber (a) and having a partitioning door 22 at one end thereof which chamber (b) can be connected with or can be separated from the atmosphere isolation chamber (a) through the partitioning valve 4; an inert gas plasma heater 23 vertically movably installed at the ceiling of the atmosphere isolation chamber (b) which heater can have a non-transfer mode; a re-refining vessel 27 movable between a molten metal-receiving position (27') for receiving molten metal from the tilted inductive heating refining furnace 5 and a re-refining position (27) directly under the inert gas plasma heater 23 via the opening of the valve 4 while using a track and cart 24, which re-refining vessel has at its top a cover 27*a* that can be opened or closed when brought up or down and rotated around a horizontal pin and that has an opening allowing the inert gas plasma heater 23 to be inserted, the re-refining vessel being provided at its bottom with a porous plug 28 and a sliding nozzle 29; a ventilation system 6*b* including a valve; an inert gas supply system 7*b* including a valve; and casting ingot cases 30 and its cart 31.

Operation is performed while using the equipment shown in FIG. 1 and the following procedure.

A solid material or molten metal prepared by melting and primarily refining a material in an arc furnace is supplied into the inductive heating refining furnace 5 through a ladle while the cover 3 is removed. Then, the cover 3 is subsequently attached, and the vacuum evacuation system 6*a* is operated to evacuate the interior of the atmosphere isolation chamber (a), or a predetermined type of gas is further supplied to generate an inert atmosphere, and then the refining is commenced in the inductive heating refining furnace 5.

Regarding the refining, the reduced-pressure-refining of molten metal is performed by the inductive heating refining furnace 5 for a predetermined period of time while keeping a required temperature in the atmosphere isolation chamber (a) in a vacuum atmosphere of 1 Torr or less or an inert gas atmosphere of 200 Torr or less. The reduced-pressure-refining allows the molten metal to be refined surely at a predetermined level because the refining temperature and the period of time can be substantially arbitrarily selected in compliance with the heating capability of the inductive heating.

At the same time, in the atmosphere isolation chamber (b), the lining refractory of the re-refining vessel 27 that had been externally preheated previously or that had just had the melt of the last operation discharged to thereby be still very hot is heated under such a state as no molten metal exists, in an inert gas atmosphere of a pressure near the surrounding atmospheric pressure as occasion demands, by use of the inert gas plasma heater 23 set in the non-transfer mode. By heating the lining refractory to an appropriate temperature that may be the molten metal-discharge temperature or lower or higher, the refractory can be passivated without being contaminated by air and combustion-produced gases, thereby minimizing both the contamination of molten metal and a decrease in temperature when the molten metal is received in the vessel. When the refining in the atmosphere isolation chamber (a) is completed or when the heating in the atmosphere isolation chamber (b) or the casting in the ingot cases 30 is completed, the operation of the inert gas plasma heater 23 in the atmosphere isolation chamber (b) is stopped and at the same time the inert gas plasma heater is raised and the evacuation system 6*b* is operated to evacuate the atmosphere isolation chamber (b) to make both of the chambers be in the same pressure. The partitioning valve 4 is then opened, and the re-refining vessel 27 is moved to the position 27' in the atmosphere isolation chamber (a) through the opening of the valve 4 while using the track and cart 24. During this operation, the cover 27*a* of the re-refining device 27 remains closed to prevent heat dissipation.

After the movement of the re-refining vessel 27 is finished, its cover 27*a* is opened, and the inductive heating refining furnace 56 is tilted to pour the molten metal into the re-refining vessel 27 (vessel renewal). After the pouring, the subsidiary raw feeding-system 9 is used to add slag-forming agents and additional alloy materials as required (since the container has been renewed, the addition of the slag-forming agents does not cause any slag contamination due to scum and etc.). The molten metal pouring and addition of the subsidiary raw materials can be efficiently performed because the cover 27*a* is opened to provided a required and sufficient opening and because these operations are performed at the same location. The track and cart 24 is subsequently used to move the re-refining vessel retaining the molten metal to the re-refining position 27, and the vessel is then heated by the inert gas plasma heater to heat and to melt the slag-forming agents. During these operation, the atmosphere isolation chamber (b) may be at the surrounding atmospheric pressure.

Preferably, a gas may be blown from the porous plug 28 into the melt via the inert gas feeding system 7*b* to stir the molten metal, thereby causing fresh active slag to absorb drossy or scummy suspended matter and/or adhesive matter that has flown into the re-refining vessel 27 together with the molten metal during tilt-pouring or to absorb contaminants caused by the refractories of the container itself, before they melt and diffuse within the molten metal. The maximum refining effect can thus be obtained when the re-refining vessel 27 receives melt quickly while having been previously heated at a high temperature.

After re-refining is finished and the molten metal is killed, the molten metal is poured into the ingot case 30 via a sliding nozzle 29 for casting.

For efficiently casting the molten metal in the ingot cases 30, a casting cart 31 is preferably installed within the atmosphere isolation chamber (b) so that the ingot case 30 may be set, and a partitioning door 22 is also preferably installed so that the cases may be transferred horizontally. Incidentally, even in a case where, after this re-refining is completed, the molten metal is transported through the re-refining vessel 27 by an overhead travelling crane and is then cast in the surrounding atmosphere, the same good effects can be obtained.

Next, the advantages of the method of the invention are described with reference to various examples of experiments. The molten metals of high-Ni stainless steel were used in all the experiments. In the drawings explained below, circles, crosses, broken lines, and solid lines represent the concentration of $O_2$ gas in the molten metal, concentration of $N_2$ gas in the molten metal, the high-Ni stainless steel, and the high-grade carbon steel for springs, respectively.

Figure 3:
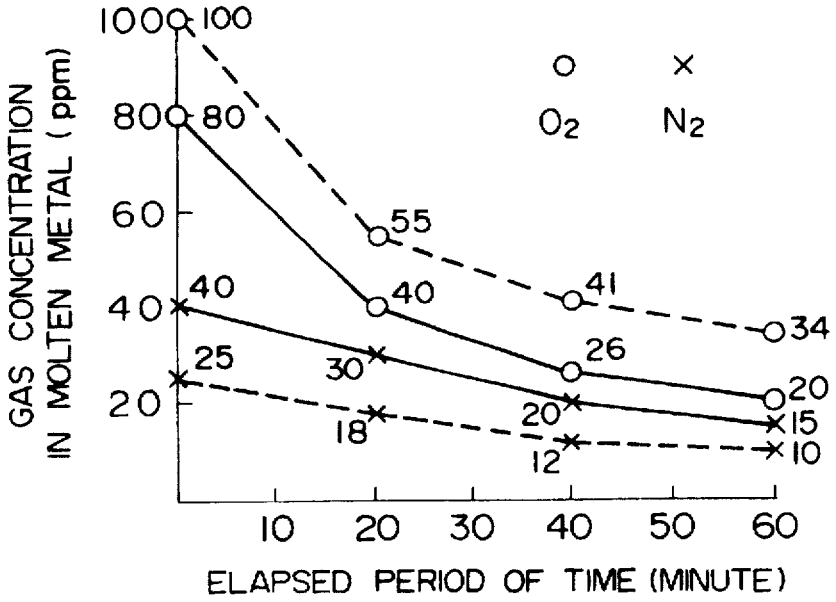
FIG. 3 is a graph which shows the progress of refining vs. the elapsed time of refining by using the concentrations of $O_2$ and $N_2$ gases in steel when molten metal having been primarily refined in an arc furnace is reduced-pressure-refined in an vacuum induction furnace.

FIG. 3 shows the progress of refining vs. elapsed period of time when the molten metal was first refined in an arc furnace and was successively poured into a vacuum inductive heating refining furnace to thereby perform the reduced-pressure-refining relating to the invention, which progress of refining is expressed by the measured concentrations of $O_2$ and $N_2$ gas contained in the molten metals.

From FIG. 3, it is found that the refining progresses rapidly as time lapses.

Figure 4:
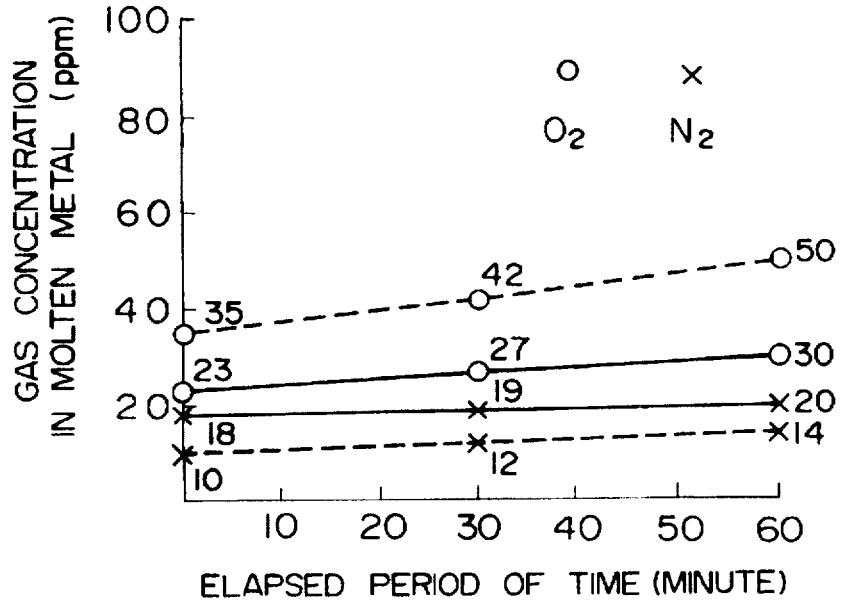
FIG. 4 is a graph which shows the state of pollution when, after the reduced-pressure-refining (FIG. 3), the furnace is tilted to discharge molten metal into a vessel, and the molten metal is then left in the state as it is.

FIG. 4 shows the measurement results of gas concentrations in a case where the molten metal subjected to the above-described reduced-refining (60 minutes) was tilt-poured into a re-refining vessel the lining refractory of which had been previously heated up to a range between a predetermined molten metal discharging temperature and a temperature defined by subtracting 150° C. from the discharge temperature by using the inert gas plasma heater, and then the molten metal was left as it was, for sixty minutes.

This figure shows that the gas concentrations measured just after the molten metal was received were approximately at the same level as the value at the time of completion of refining, but the gas concentrations increased as time lapsed. It can be assumed that this increase was due to the re-mixing of impurities into the molten metal which occurred during the tilt-pouring.

Figure 5:
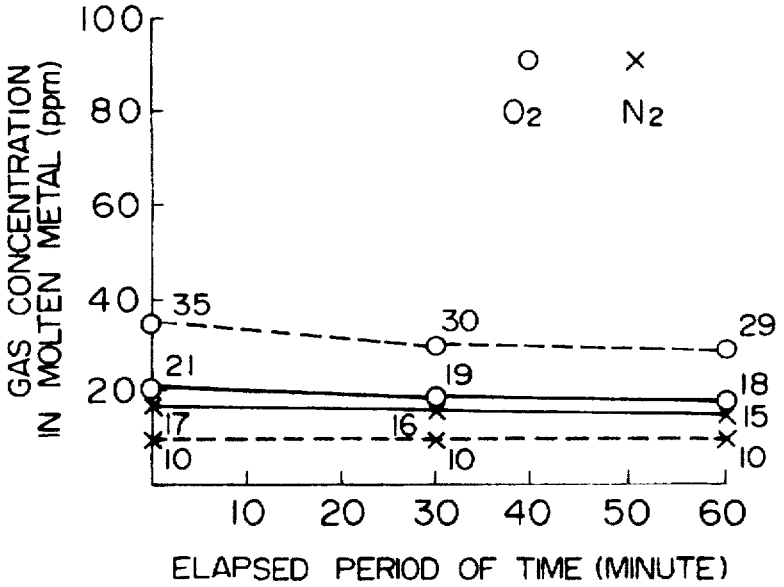
FIG. 5 is a graph which shows the concentrations of gases in molten metal when the re-refining of this invention is performed after the reduced-pressure-refining (FIG. 3)

FIG. 5 shows changes in gas concentrations during the re-refining performed in accordance with the invention in a case where molten metal refined under the same conditions as in the above described reduced-pressure-refining was tilt-poured under the same conditions as described above into a re-refining container the lining refractory of which had been previously heated by using the inert gas plasma heater up to the same temperature as described in FIG. 4, wherein the re-refining was performed while adding slag-forming agents to the molten metal and stirring the melt by use of argon gas blown from the porous plug provided at the bottom of the furnace, and while heating the molten metal from the upper portion thereof by inert gas plasma. This figure shows that in the re-refining relating to the invention the re-contaminated substances were prevented from re-melting into the molten metal and that the gas concentration gradually decreased as time lapsed and that the refining level of this re-refining was higher than that of the reduced-pressure-refining.

The re-refining period of time required for the invention is 30 to 60 minutes.

Figure 6:
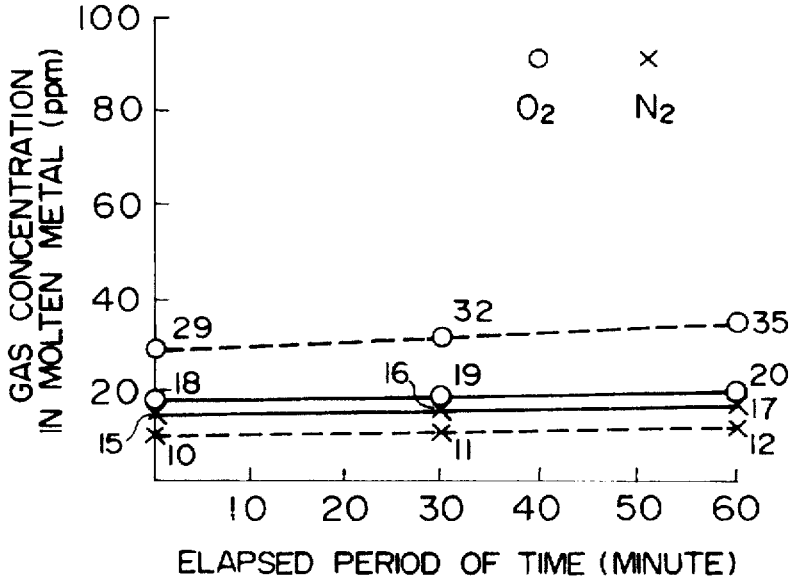
FIG. 6 is a graph which shows a relationship between elapsed time and the concentrations of gases in molten metal when the molten metal is calmed after the re-refining performed in compliance with the invention (FIG. 5)

FIG. 6 shows the relationship between killed time and the concentrations of gases in the molten metal when the molten metal is killed and retained in the re-refining vessel under the same conditions as in FIG. 4 after the re-refining had been performed in accordance with the invention so as to observe the effect of the killing and retention treatment performed prior to the casting of the molten metal.

This figure shows that, in the molten metal re-refined for 60 minutes in accordance with the invention, the increase in concentrations of gases in the molten metal is much smaller than that in FIG. 4 and has a lower absolute value level even after the killing of 60 minutes. It can thus be understood that an ingot having a purity as re-refined can be provided. Similarly, in such an experiment as the molten metal was re-refined for thirty minutes and then similarly calmed, there were obtained results substantially similar to the above-described results.

Figure 7:
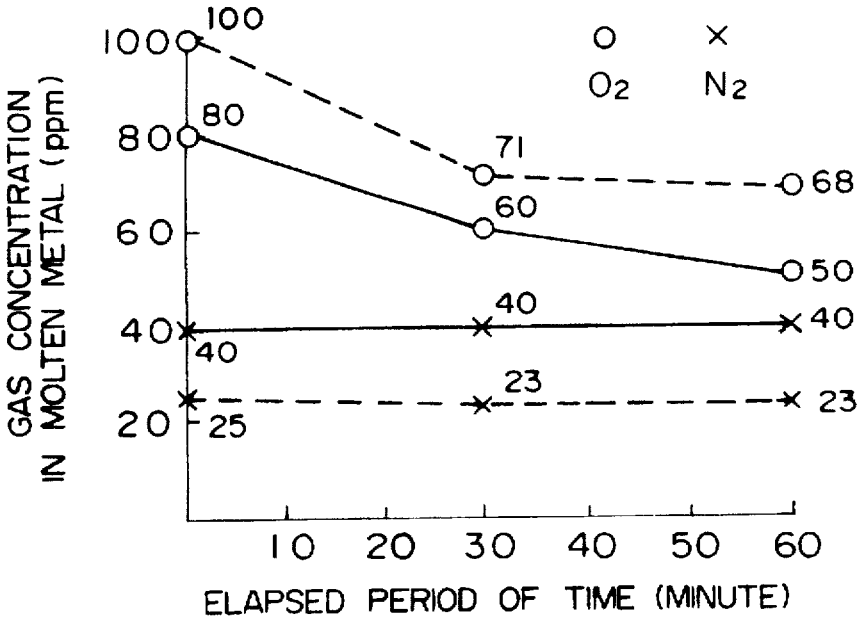
FIG. 7 is a graph which shows a relationship between refining time and the concentrations of gases in molten metal when molten metal having been reduced-pressure-refined in an arc furnace is refined under the same conditions as those in the re-refining of this invention.

FIG. 7 shows the results of measurement regarding the concentrations of gases in molten metal vs. lapse of period of time in a case where the molten metal having been first refined in an arc furnace (which molten metal is substantially similar to the molten metal used in the experiment disclosed in FIG. 3) was poured directly into the re-refining container relating to the invention without subjecting the molten metal to the vacuum refining, and then the refining was performed under the same conditions as in the above experiment described regarding FIG. 5 (, that is, the presence of slag, the stirring by gas blowing, and the inert gas plasma heating; this refining is hereinbelow referred to as "inert gas plasma refining").

This figure shows that the inert gas plasma refining method has a very high refining effect. However, regarding the speed of refining, the inert gas plasma refining method is considerably inferior to the vacuum refining method, so that it is advantageous to use the vacuum refining method at the low refining level and then to use the inert gas plasma refining method to perform re-refining to remove impurities having been re-mixed during tilt-pouring.

Figure 8:
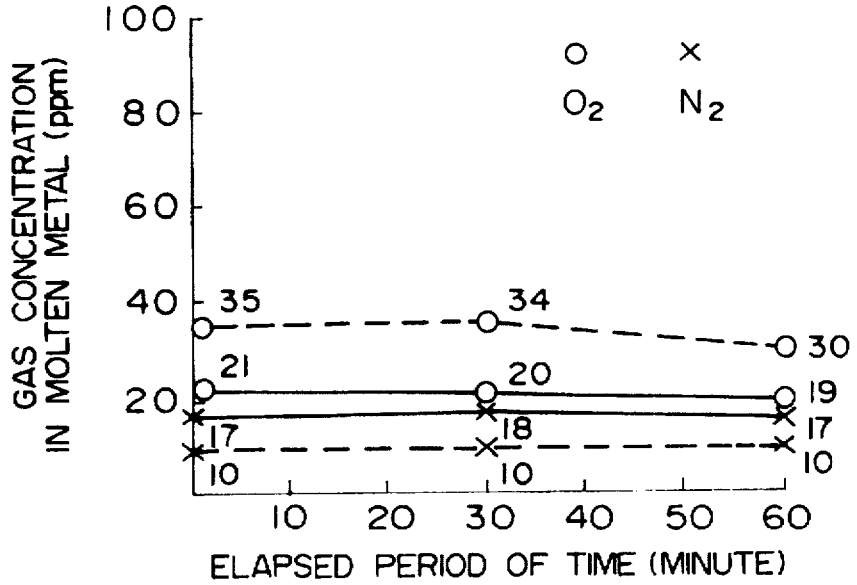
FIG. 8 is a graph which shows changes in the concentrations of gases in molten metal when the heating temperature for the re-refining vessel is decreased.

FIG. 8 shows changes in gas concentrations in a case where molten metal was received and re-refined under the same conditions as those disclosed regarding FIG. 5 with the exception of the respect that the lining refractory of the re-refining vessel is heated up to a temperature defined by substracting 300° C. from a predetermined molten metal-pouring temperature. According to FIG. 8, the gas concentration remains almost unchanged for 30 minutes after the commencement of the re-refining and decreases after 60 minutes from the re-refining. This clearly shows the effect of increasing of the heating temperature of the re-refining vessel shown in FIG. 5.

FIG. 8 also demonstrates the effectiveness of the invention in that the re-contaminated impurities explained regarding FIG. 4 is prevented from occurring during the re-refining.

Embodiment 2

Operation was performed while using the apparatus shown in FIG. 1. After an Fe—Ni alloy had been melted in an arc furnace in the surrounding atmosphere, oxygen was blown into the molten metal to sufficiently decarbonize it. The molten metal was then poured into the inductive heating refining furnace 5 while using a ladle. In this case, the molten metal was poured into the furnace 5 through a sliding nozzle installed at the bottom of the ladle to thereby minimize the mixing of slag caused during the decarbonization. A cap 3 was subsequently attached, and the evacuation system *6a* was actuated to evacuate the interior of the atmosphere isolation chamber (a), where the reduced-pressure-refining was then performed by use of the inductive heating furnace.

In parallel therewith, the preheated re-refining container had been set outside the atmosphere isolation chamber (a). When the refining in the atmosphere isolation chamber (a) was finished, the partitioning valve 4 was opened, and the re-refining container 27 was moved through the opening of the valve 5 to the position 27' in the atmosphere isolation chamber (a) while using the track and cart 24.

The inductive heating refining container 5 was tilted to pour the molten metal into the re-refining container 27. After pouring, slag-forming agents were added to the molten metal through the sub-material feeding system 9. Then, by the track and cart 24, the re-refining container retaining the melt was moved to the position 27 quickly, where re-refining was performed by heating and melting the slag-forming agents through the inert gas plasma heater while stirring the melt by an Ar gas blown from the porous plug 28 through the inert gas introduction system *7b*.

After the re-refining was finished and the molten metal was calmed in a predetermined manner, the molten metal was poured into the ingot case 30 via the sliding nozzle 29 for casting.

Embodiment 3

Figure 9:
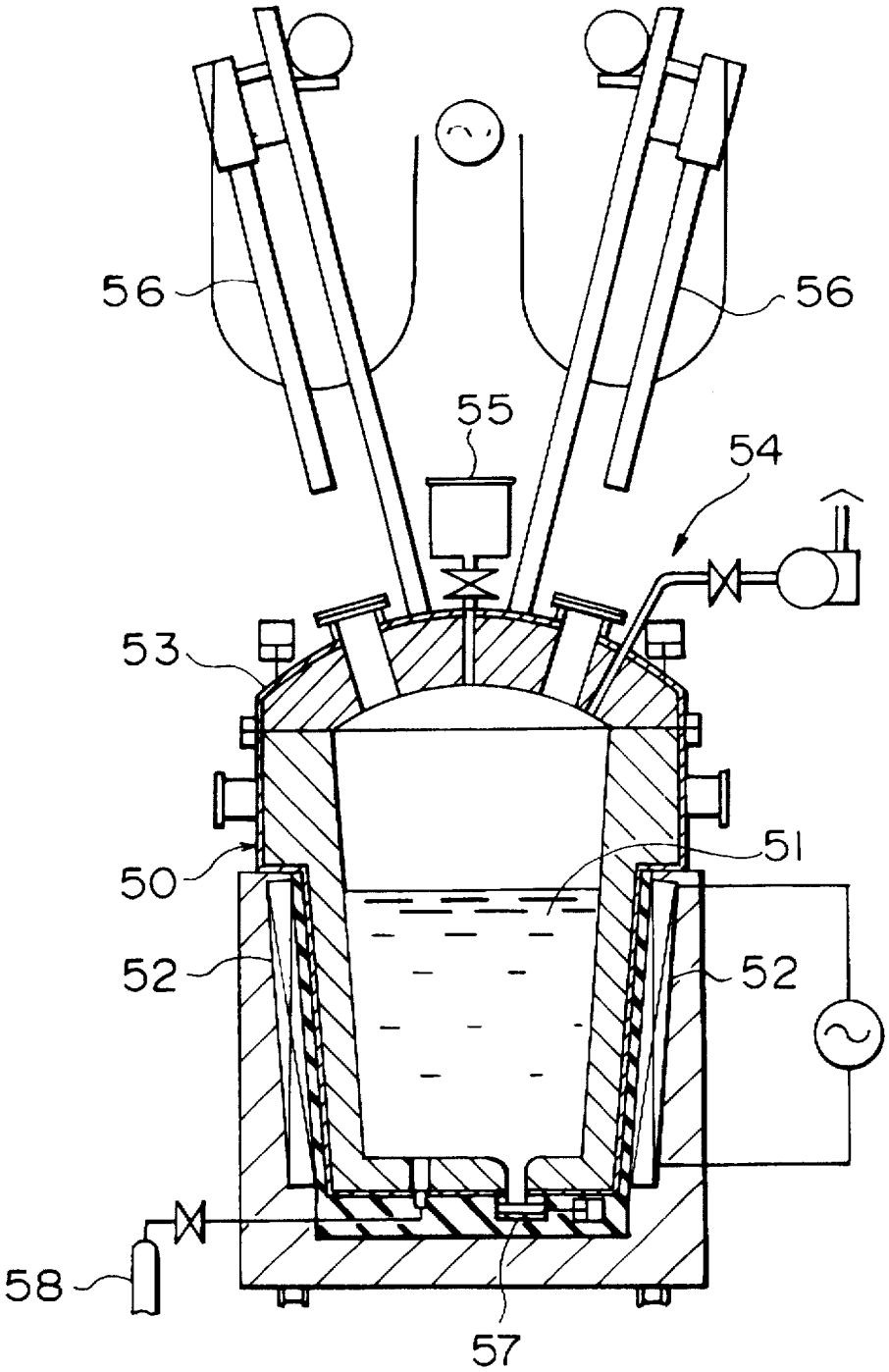
FIG. 9 is a partially sectional view which illustrates an apparatus embodying the invention wherein reduced-pressure-refining and re-refining are performed in the same furnace.

Operation was performed while using the apparatus shown in FIG. 9.

Molten metal produced by melting and decarbonization refining an Fe-42Ni alloy in the same manner as in Embodiment 1 while using an arc furnace was poured via the ladle (not shown) into a ladle 50 shown in FIG. 9. A ladle vacuum cover 53 was set, and the interior of the ladle 50 was evacuated to commence reduced-pressure-refining. After the reduced-pressure-refining was finished, the evacuation system 54 was stopped, and an argon gas was blown from the argon bottom blowing stirrer 58 to thereby fill the ladle 50 with argon gas. After slag-forming agents were then added from the feeder 55, re-refining was subsequently performed while inserting a plasma heating torch 56 into the ladle 50 from the outside of the ladle vacuum cover 53 so as to start plasma heating and while blowing an argon gas into the molten metal from the argon bottom blowing stirrer 58 to stir the molten metal. An inductive heating coil 52 is activated to promote the blowing stirring of an argon gas. After re-refining was finished, the sliding nozzle 57 was opened to discharge the molten metal into the ingot case located under the sliding nozzle In embodiment 2, the slag-forming agents comprising CaO and $CaF_2$ at a ratio of 1 to 1 was added for 20 kg per ton of molten metal during re-refining. However, in embodiment 3, there were performed two cases, in one of which cases only electromagnetic stirring was used while adding the slag-forming agents comprising CaO and $Al_2O_3$ at a ratio of 1:1 for 20 kg per ton of molten metal, and in another of which cases both the electromagnetic stirring and Ar gas blowing stirring from the porous plug were used while adding the slag-forming agents comprising CaO, $CaF_2$, and $Al_2O_3$ at a ratio of 2:1:1 for 20 kg per ton of molten metal during re-refining.

Table shows and the S values measured after 30-minute re-refining in each of both a comparative method in which no stirring was performed with the relative level of the measured O and S values being assumed to be 10 and the method of the invention in which there was performed the stirring in accordance with the invention with the level of the measured O and S values being shown to be the ratios thereof to those of the comparative method.

TABLE 1

| Slag-forming agents Stirring means | CaO, $CaF_2$ Ar Blow | | CaO, $Al_2O_3$ Electro-magnetic stirrer | | CaO, $CaF_2$, $Al_2O_3$ Ar Blow + electromagnetic stirrer | |
|---|---|---|---|---|---|---|
| Element | O | S | O | S | O | S |
| With stirring 30 min | 6.8 | 5.4 | 6.2 | 5.4 | 5.7 | 5.3 |
| Without stirring 30 min | 10 | 10 | 10 | 10 | 10 | 10 |

Table 1 shows that stirring of the molten metal in a container during re-refining is very effective.

Although, in the above embodiment, the invention has been disclosed in connection with the use of vacuum refining adopted as an example of the reduced-pressure-refining, this invention is not limited to this aspect. That is, in a case of certain alloy components contained in the molten metal to be refined, an inert gas atmosphere of an absolute pressure of 200 Torr or less is usually selected to prevent or minimize the loss of these components due to vaporization, which is also applicable to this invention.

In addition, although, in the above embodiments, the molten metal for vacuum refining was metal which had been previously melted and primarily refined in another melting furnace, this invention is not limited to this aspect and a cold material may be melted and may be reduced-pressure-refined.

As described above, in the invention there is first used the reduced-pressure-refining method performed by use of the refining furnace having heating means in accordance with a wide range of required refining level and/or kind of materials under vacuum or under low oxygen partial pressure atmosphere including inert gas not more than 200 Torr so that molten metal is surely refined efficiently down to a relatively high, predetermined level, and then the molten metal is poured into the renewed heated vessel provided with the cover attached detachably and freely openable or closable for making it possible to quickly receive the molten metal so that the molten metal is effectively plasma-heated and re-refined under slag to thereby remove re-mixed impurities such as adhesive on furnace wall and floating substances before the impurities are again melted in the whole of the molten metal.

By performing the re-refining of the molten metal under plasma heating and stirring in accordance with the method of the invention, refining is promoted while the stirred new molten metal is always in contact with the slag-forming agent on its surface.

Further, in the apparatus of the invention, since the reduced-pressure-refining furnace is located adjacently to the inert gas plasma re-refining position, re-refining can be initiated at a higher temperature immediately after the reduced-pressure-refining to thereby perform effectively the method of the invention. In the case where the prerefining furnace and the inert gas plasma heater are installed in different atmosphere isolation chambers independent each other, the renewed container can be moved quickly between the chambers under such condition as the pressure of one chamber is made to be at the same level as that of the other, and the influence of the atmosphere on the molten metal can be completely avoided. In addition, the use of a vessel having a openable and removable cover as a renewed re-refining vessel makes it possible to perform the addition of sub-materials at the same position as the re-refining or at a position in the vicinity of the position of the re-refining.

We claim:

1. A method for refining molten metal to remove contaminants, comprising the steps of:

removing the contaminants from a molten metal by treating said molten metal under vacuum or under low oxygen partial pressure atmosphere in a heated vessel to provide refined molten metal, forming slag by adding slag-forming agents into said refined molten metal, and activating said slag by heating the refined molten metal with an inert-gas plasma to separate or remove any residual ones of the contaminants in the refined molten metal under substantially atmospheric pressure.

2. A method for refining molten metal to remove contaminants, comprising the steps of:

removing the contaminants from a molten metal by treating said molten metal under vacuum or under low oxygen partial pressure atmosphere in a first vessel to provide refined molten metal, transferring said refined molten metal to a second vessel, forming slag by adding slag-forming agents into said refined molten metal, and activating said slag by heating the refined molten metal with an inert-gas plasma to separate or remove any residual ones of the contaminants in the refined molten metal under substantially atmospheric pressure.

3. A method for refining molten metal as set forth in claim 2, wherein said second vessel includes a refractory lining and a temperature difference between the highest temperature in the refractory lining of said second vessel and the temperature of the refined molten metal transferred to the second vessel is 150° C. or less.

4. A method for refining molten metal as set forth in claim 2, wherein said second vessel includes a cover and said molten metal is transferred to the second vessel while opening the cover of the second vessel.

5. A method for refining molten metal as set forth in claim 1, wherein said heated vessel includes an induction heater.

6. A method for refining molten metal as set forth in claim 2, wherein said refined molten metal is transferred into said second vessel by tilting the first vessel.

7. A method for refining molten metal as set forth in any one of claims 1 to 6, wherein the activation of said slag is performed while heating the refined molten metal with inert gas plasma and while stirring said refined molten metal.

8. Refining apparatus for providing refined molten metal, comprising a first reduced pressure furnace having heating means, and a second furnace located adjacent to said heated first furnace and having an inert-gas plasma heater for activating said slag under substantially atmospheric pressure and having material feeding means for adding material including slag-forming agents to the refined molten metal.

9. Refining apparatus for providing refined molten metal comprising:

first and second chambers isolated from surrounding atmosphere, each of said chambers being provided with exhaust means, said first chamber being provided with a first furnace having heating means, said first furnace being adapted to discharge refined molten metal, said second chamber being provided with an inert-gas plasma heater which acts under substantially atmospheric pressure, a second vessel transferable between a first location at which said second vessel receives said refined molten metal from said first furnace and a second location at which said refined molten metal is heated with said inert-gas plasma heater, and material-feeding means for feeding materials including slag-forming agents into said second vessel.

10. Refining apparatus for providing refined molten metal, comprising:

first and second chambers isolated from surrounding atmosphere, each of said first and second chambers being provided with exhaust means, said first chamber being provided with a furnace having heating means, said first furnace being adapted to discharge refined molten metal said second chamber being provided with an inert-gas plasma heater which is under substantially atmospheric pressure, a second vessel transferable between a first location at which said second vessel receives therein said refined molten metal from said first heated furnace and a second location at which said refined molten metal is heated with said inert-gas plasma heater, said second vessel including a cover, and material-feeding means for feeding materials including slag-forming agents into said second vessel, said material-feeding means being located at said first position or said second position.

11. Refining apparatus for molten metal as set forth in anyone of claims 8 to 10, said first chamber being adapted to isolate the surrounding atmosphere and provided with exhaust means, said inert gas plasma heater being located adjacent to said first chamber, and said second vessel being transferable between the first chamber and said inert gas plasma heater.

12. Refining apparatus for molten metal as set forth in claim 9 or 10 wherein, said first furnace includes an induction heater.

13. Refining apparatus for molten metal according to claim 9, wherein said first chamber is connected to said second chamber.

14. Refining apparatus for molten metal according to claim 9, wherein said first chamber is detached from said second chamber.

15. Refining apparatus for molten metal according to claim 10, wherein said first chamber is connected to said second chamber.

16. Refining apparatus for molten metal according to claim 10, wherein said first chamber is detached from said second chamber.

* * * * *